US006199231B1

(12) United States Patent
Zafiroglu

(10) Patent No.: US 6,199,231 B1
(45) Date of Patent: Mar. 13, 2001

(54) FITTED MATTRESS COVER WITH STRETCHABLE KNIT SKIRT

(75) Inventor: Dimitri Peter Zafiroglu, Wilmington, DE (US)

(73) Assignee: Xymid, L.L.C., Petersburg, VA (US)

( * ) Notice: Subject to any disclaimer, the term of this patent is extended or adjusted under 35 U.S.C. 154(b) by 0 days.

(21) Appl. No.: 09/275,763

(22) Filed: Mar. 24, 1999

Related U.S. Application Data

(63) Continuation-in-part of application No. 08/886,821, filed on Mar. 5, 1997, now abandoned.

(51) Int. Cl.[7] ..... A47G 9/00
(52) U.S. Cl. ..... 5/497; 5/498; 5/499
(58) Field of Search ..... 5/497, 498, 499, 5/482; 66/192, 196, 193; 112/475.01, 163, 252; 496/102, 98

(56) References Cited

U.S. PATENT DOCUMENTS 2,942,280 6/1960 May .
3,273,175 9/1966 Anderson et al. .
4,985,953 1/1991 Seago .
5,127,115 7/1992 Williams et al. .
5,187,952 2/1993 Zafiroglu .
5,247,893 9/1993 Zafiroglu .
5,603,132 * 2/1997 Zafiroglu .
5,636,393 6/1997 Zafiroglu .

* cited by examiner

*Primary Examiner*—Terry Lee Melius
*Assistant Examiner*—Fredrick Conley
(74) *Attorney, Agent, or Firm*—Lawrence Isakoff

(57) ABSTRACT

A fitted mattress cover has a fabric skirt warp-knit from bulked yarns and elastic yarns. The skirt is elastically stretchable in the longitudinal direction by at least 50%, inelastically stretchable in the transverse direction by at least 60%, and regains its transverse stretch characteristics when laundered and dried in a relaxed condition and possesses important advantages over known stretchable stitchbonded skirts in wash durability, stretch/conformability, and puncture resistance, as well as in economy of manufacture.

9 Claims, 1 Drawing Sheet

FITTED MATTRESS COVER WITH STRETCHABLE KNIT SKIRT

CROSS-REFERENCE TO RELATED APPLICATION

This is a continuation-in-part of application Ser. No. 08/886,821, filed Mar. 5, 1997, now abandoned.

BACKGROUND OF THE INVENTION

1. Field of the Invention

This invention relates to a fitted mattress cover that has a stretchable knitted skirt. More particularly, the invention concerns such a fitted mattress cover in which the skirt is knit from elastic yarns and bulked yarns and has a particular elastic stretch in the longitudinal and a particular inelastic stretch in the transverse directions. The cover fits easily, neatly and snugly on mattresses of different thickness.

2. Description of the Prior Art

Fitted mattress covers comprise a flat top panel of substantially inextensible material and a skirt that depends from the periphery of the top panel. In use, the top panel covers the top of surface of the mattress and the skirt covers the sides of the mattress. Mattresses to which the covers are fitted typically have a thickness in the range of about 7 to about 15 inches. As used herein, the term "longitudinal direction" refers to the direction that follows around the long dimension of the sides of a mattress and the term "transverse direction" refers to the direction that is perpendicular to the longitudinal direction and is parallel to the thickness dimension of the mattress.

Known fitted mattress covers have often included skirts having specially constructed corners or an elastic tape attached to the bottom edge of the skirt, to help hold the fitted mattress cover in place. Early embodiments of such fitted mattress covers were described by Anderson et al, U.S. Pat. No. 3,237,175, column 1. May, U.S. Pat. No. 2,942,280, disclosed one such fitted mattress cover having an inwardly sloping skirt made of a cotton fabric commonly used in undergarments, the end and side walls of the skirt being connected at each corner to form progressively tapered corners, and the bottom edge of one end wall containing an elastic tape, the skirt having extensibility primarily in one direction, the transverse direction. Each of these early fitted mattress covers had skirts that lacked substantial elastic retractive power in the longitudinal direction of the skirt, and accordingly seldom provided a neat, snug fit of the cover to the mattress.

More recently, Seago, U.S. Pat. No. 4,985,953, disclosed a fitted mattress cover having a skirt formed of a gathered layer of inelastic material to which a plurality of spaced apart elastic cords were attached in the longitudinal direction parallel to the periphery of the top panel. The skirt is elastic only in a direction parallel to the elastic cords (i.e., in the longitudinal direction of the skirt) and is substantially not stretchable in the transverse direction. Consequently, mattress covers having such skirts generally are not suited for use over the full range of conventional mattress thicknesses.

Various fitted mattress covers having stretchable skirts of stitchbonded fabrics have been suggested. Some such stitchbonded fabric skirts have substantial elastic stretchability and retractive power in the longitudinal direction as well as some stretchability in the transverse direction. The mattress covers with these types of skirts are intended to accommodate the different thicknesses with which mattresses usually are manufactured. For example, Zafiroglu, the present inventor, in U.S. Pat. Nos. 5,187,952 and 5,247,893, discloses a fitted mattress cover having an elastic fitted skirt formed from a stitchbonded fabric comprising a substantially nonbonded fibrous layer in which elastic yarns, such as spandex elastomeric yarns, are stitched to create lanes of different stretchability in the fabric. The skirt material is capable of stretching 190% ad 60% in the longitudinal direction in the first and second lanes, respectively, and 80 to 90% in the transverse direction. The lanes of different stretchability create a striped or banded appearance in the skirt fabric. Williams et al, U.S. Pat. No. 5,127,115, also discloses a mattress cover with a stitchbonded fabric skirt that has an elastic stretch of 60% in the longitudinal direction and an inelastic stretch of about 30% in the transverse direction. Also, Zafiroglu et al, U.S. patent application Ser. No. 08/397,328, filed Mar. 2, 1995, now U.S. Pat. No. 5,636,393, issued Jun. 10, 1997 discloses a fitted mattress cover having another stitchbonded fabric skirt that does not have a banded appearance. The skirt has a stretchability that is greater in the transverse direction than in the longitudinal direction. The total stretchability in the longitudinal direction is 100 to 200%, with less than half of the stretch being recoverable and the total stretchability in the transverse direction is less than 60% with less one-third of the stretch being recoverable. Zafiroglu, U.S. Pat. No. 5,603,132, discloses a fitted mattress cover having still another stitchbonded skirt that does not have a banded appearance. The stitchbonded skirt is stretchable by at least 50% in the longitudinal direction and at least 100% in the transverse direction, with at least 80% of the longitudinal stretch and at least 30% of the transverse stretch being elastically recoverable. Although fitted mattress covers with such stitchbonded fabric skirts have met with some success in the bedding market, further improvements are desired. The present inventor has found that some mattress covers made with skirts of stitchbonded fabrics that incorporate nonwoven layers of substantially non-bonded or non-entangled fibers, sometimes are prone to mechanical failure and to pilling, especially when the covers are laundered. The present inventor also found that mattress covers made with skirts of stitchbonded fabrics that incorporate nonwoven layers of strongly bonded or highly entangled fibers, though stronger and less prone to pilling, usually do not have sufficient transverse stretch to permit use with mattresses of different thicknesses.

The aim of the present invention is to provide a fitted mattress cover having a skirt which stretches in both the longitudinal and transverse directions so that the cover can be fitted neatly and snugly onto mattresses of different thicknesses, retains its desirable characteristics even after several launderings and does not suffer the shortcomings of mattress covers made with skirts of stitchbonded fabrics.

SUMMARY OF THE INVENTION

The present invention provides a fitted mattress cover. The mattress cover has a top panel of an inextensible fabric for overlaying the top surface of a mattress and a skirt of a stretchable knitted fabric, attached to and depending from the periphery of the top panel, for covering the sides and ends of the mattress. The stretchable knit fabric of the skirt comprises bulked yarns and elastic yarns. Preferably, the elastic yarns of the knitted skirt fabric are stretch yarns, elastomeric yarns or elastic combination yarns. A particularly preferred elastic yarn is a combination yarn of spandex air-jet entangled with textured filaments of nylon or polyester. The yarns form one or more repeating stitch patterns. The stitches have floats that connect successive courses and wales of the stitch patterns. The courses extend in a transverse direction which is perpendicular to the periphery of the top panel. Successive courses are separated by a distance, $d_c$, that is at least 1.25 millimeters. The wales extend in a longitudinal direction which is parallel to the periphery of the top panel. Successive wales in the pattern of stitches that have the longest floats are separated by a distance, $d_w$, which is no greater than $d_c$, and the ratio, P, (referred to herein as the "pattern ratio") of $d_c$ to $d_w$ is at least 1.0, preferably at least 1.2, and more preferably at least 1.4. The skirt has an upper edge and a lower edge, each of which extend in the longitudinal direction. Optionally, each edge has an elastic band or elastic yarn incorporated therein. Preferably, the knitted skirt fabric has an elastic stretch in the longitudinal direction, of at least 50%, more preferably in the range of 75 to 150%, and an inelastic stretch in the transverse direction of at least 60%, more preferably in the range of 100 to 200%. After the cover is removed from a mattress to which it was fitted, the skirt can substantially regain its original transverse dimensions and stretch characteristic by washing and drying the cover, or by simply tensioning the skirt in the longitudinal direction.

The present invention also provides a process for making the above-described fitted mattress cover. The process comprises the steps of forming the top panel; warp-knitting the skirt fabric with bulky yarns and elastic yarns under tension so that the as-knit courses are at least 1.25-mm apart and successive wales (defined as above) are no further apart than the distance between courses; contracting the as-knit skirt fabric in at least its longitudinal direction to a length that is one-half to one-third its non-contracted as-knit length; and attaching the skirt fabric material to the top panel.

BRIEF DESCRIPTION OF THE DRAWINGS

The invention will be better understood by reference to the drawings wherein.

DETAILED DESCRIPTION OF PREFERRED EMBODIMENTS

For convenience and clarity, definitions will now be given of several terms that are used herein.

"Elastic" refers to the property of a fiber, filament, yarn or fabric to stretch when under tension and then, when the tension is released, to retract quickly and forcibly to its original length.

"Spandex" is a manufactured elastic fiber-forming substance is a long chain synthetic polymer that is comprised of at least 85% by weight segmented polyurethane. Typically, yarns of spandex are capable of elastic stretch of at least 300%, and often over 600%. Such yarns exert significant retractive force when in a stretched condition.

A "bulked yarn" is yarn that has been treated to have a notably greater apparent volume or bulk and still have sufficient stability to withstand yarn processing tensions and the normal forces exerted on garments during wear.

A "stretch yarn" is a yarn made from thermoplastic filaments (e.g., of nylon or polyester) which has been treated so that the yarn is capable of a pronounced degree of stretch and rapid recovery. In contrast, conventional drawn thermoplastic yarns, which typically stretch elastically less than about 15% and break at an elongation of less than 35%, are considered herein to be non-elastic.

An "elastic combination yarn" is a yarn that has at least two dissimilar yarn components. One component is an elastic yarn (e.g., LYCRA® spandex, manufactured by E. I. du Pont de Nemours & Co.), and another component is a conventional or textured yarn of natural or synthetic fiber. An elastic combination yarn also can be a bulked yarn.

Conventional warp-knitting stitch nomenclature is used to identify the various stitches employed in knitting the skirt fabric of the present invention. An underlap is the portion of a stitch that forms when a knitting machine shogs over the needle spaces of the knitting machine and connects successive wales and in the knit fabric of the skirt is referred to herein as a "float".

Figure 1:
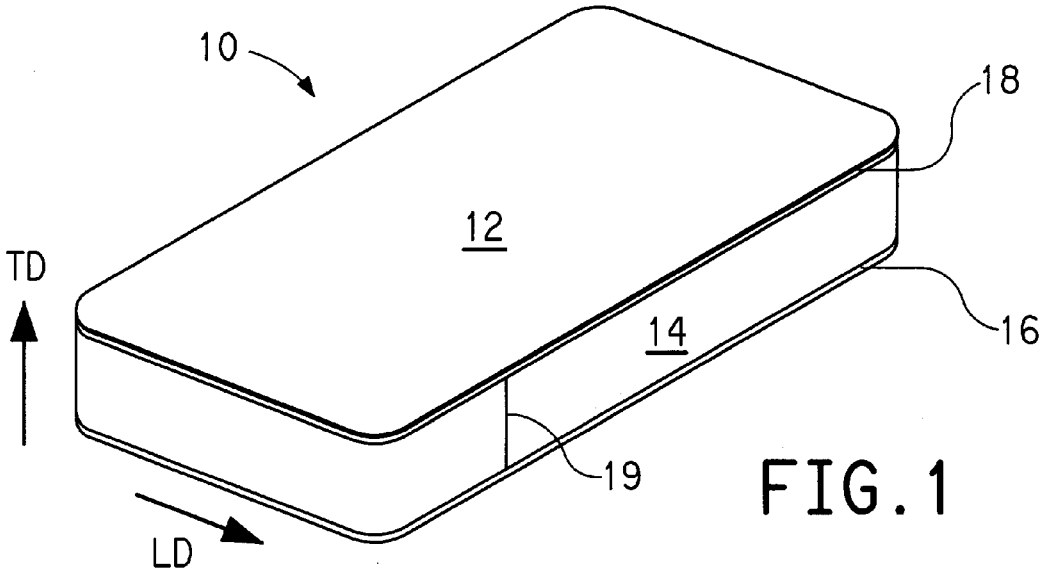
FIG. 1 is an isometric view of mattress cover 10 of the present invention having a flat top panel 12, a stretchable knitted fabric skirt 14 attached to and depending from the top panel, the skirt having a lower edge 16, an upper edge 18 and a seam 19

Preferred embodiments of the invention will now be described with reference to the drawings. FIG. 1 shows a mattress cover 10 which comprises a top panel 12 and a skirt 14. Top panel 12, preferably is a quilted padding material which optionally may include a water impermeable layer. Typically, top panel 12 is substantially inextensible and has dimensions which correspond approximately to the dimensions of the top of the mattress that is to be covered. Skirt 14 is a knitted fabric that has a high elastic stretch in the longitudinal direction (i.e., at least 50%, preferably 75 to 150%) and a high inelastic stretch in the transverse direction (i.e., at least 60%, preferably 100 to 200%). Skirt 14 also comprises upper edge 18 and lower edge 16. Optionally, elastic combination yarns or elastic tapes are stitched into the lower edge 16 and/or upper edge 18 of the skirt fabric. Elastic yarns or tapes in bottom edge 16 serve to pull the bottom portion of skirt 14 underneath the mattress on which the mattress cover is fitted. Elastic yarn or tape in upper edge 18 serves to reinforce top edge of the mattress cover and provides a location for attaching (usually by sewing) skirt 14 to top panel 12.

Skirt 14 is knit with a conventional single-bar or multiple-bar warp-knitting machine, that typically forms 5 to 20 courses per inch (2 to 8 per cm) and 15 to 60 wales per inch (6 to 24 per cm). The warp-knitting machine is threaded with elastic yarns and bulked yarns. In the skirt fabric, the elastic yarns help the skirt of the mattress cover fit snugly around the sides and ends of the mattress. The bulked yarns add desirable cover (i.e., opacity) to the skirt fabric.

The knit fabric of the skirt contains patterns of stitches, which comprise wales extending in the longitudinal direction, courses extending in the transverse direction and stitch floats connecting the wales and courses. As-knit, or when extended under tension in the longitudinal direction, courses are at least 1.25-mm apart. The pattern ratio, P, of the distance, $d_c$, between courses and the distance, $d_w$, between the successive wales of the pattern with the longest floats is at least 1.0, preferably 1.2, and more preferably 1.4. Skirts knit with at least two bars of bulked elastic combination yarns that form repeating patterns of opposing tricot-stitches are preferred. As shown in the Examples below, other types of repeating stitch patterns for the skirt fabrics of the mattress covers of the present invention can be employed. Knit fabrics for skirts of the invention may also contain some non-elastic yarns.

Typical knit skirt fabrics of the invention have a unit weight, before removal from the knitting machine and subsequent contraction, in the range of 30 to 100 grams/square meter. In a relaxed condition, the skirt fabrics typically weigh 60 to 200 g/m$^2$.

The knitted fabric employed to form skirt of the fitted mattress cover of the invention has a uniform, smooth surface. The knitted fabric can be stretched readily in both the longitudinal and transverse directions. In the longitudinal direction, the knitted fabric has an elastic stretch in the longitudinal direction of at least 50%, preferably in the range of 75 to 150%. In the transverse direction, the knitted fabric has much less elastic stretch, but can be stretched inelastically at least 60%, preferably, in the range of 100 to 200%. Typically, the longitudinal elastic stretch amounts to at least about two-thirds, and preferably at least about 90%, of the total longitudinal stretch of the knitted fabric. In contrast, in the transverse direction, the inelastic stretch is at least 40%, preferably at least about half, and more preferably at least about two-thirds of the total transverse stretch. The method by which the elastic, inelastic and total stretches in the longitudinal and transverse directions are measured is described hereinafter.

The mattress cover of the invention is prepared by a process that comprises the following steps:

(a) A flat top panel is formed from a substantially inextensible fabric. The panel has a peripheral edge. Typically, the top panel is formed by quilt stitching two layers of material with a filling material between the two layers and then cutting quilt-stitched material to correspond in size to the top of the mattress to which the cover is to be fitted.

Figure 2:
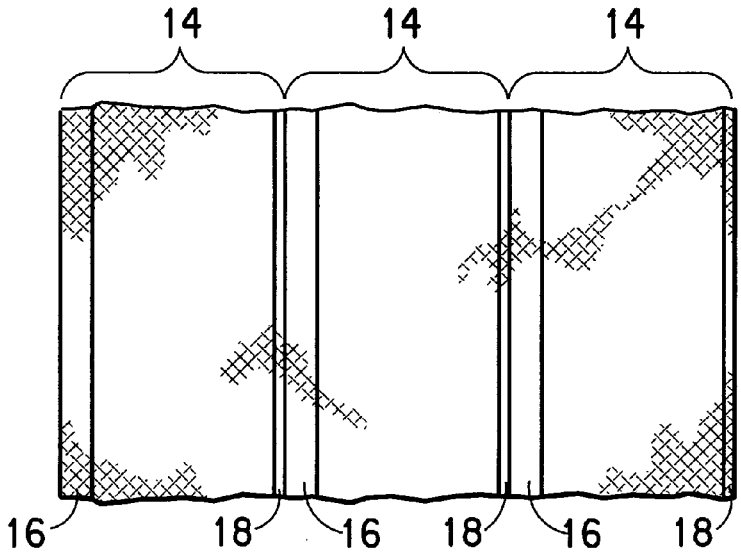
FIG. 2 is an idealized plan view of three lengths of skirt fabric 14, having lower edge 16 and upper edge 18, being knit simultaneously side by side on a warp-knitting machine.

(b) A skirt fabric is knit with bulked yarns and elastic yarns threaded on one or more bars of a warp-knitting machine. The skirt fabric is formed with upper and lower longitudinal edges. During the knitting, the bulked yarns and the elastic yarns are tensioned sufficiently to maintain the yarns in a substantially taut condition so that during the knitting, the tensioned yarns behave substantially like "hard" yarns (i.e., like non-stretch conventional drawn yarns of nylon or polyester). As a result of the knitting in this manner, the yarns have a "residual stretch" in the range of about 5 to 20%, as calculated from the actual length of yarn fed and the theoretical length of the stitches knit therefrom. The bulked yarns and the elastic yarns are knit into repeating patterns of stitches having wales and courses. Successive courses are separated by a distance, $d_c$, at least 1.25 millimeters. In the knit fabric, the pattern that has the longest floats also has the longest distance, $d_w$, between successive wales, but distance $d_w$ is never larger than the distance, $d_c$, between courses. A suitable warp-knitting machine for this step is a 15-to-60-gage tricot or a Raschel knitting machine capable of knitting 5 to 20 courses per inch (2 to 8/cm) and 15 to 60 wales per inch (6 to 24/cm). Because typical knitting machines are several meters wide, several skirts can be formed simultaneously on the machine, as illustrated in FIG. 2.

(c) The thusly knit skirt fabric is removed from the knitting machine and contracted in a direction parallel to the longitudinal edges of the skirt, such that the contracted skirt length is in the range of one-half to one-third its non-contracted as-knit length (prior to removal from the knitting machine). The contraction occurs as a result of the release of the yarn tension applied during knitting and the further contraction that occurs when the fabric is washed and dried.

(d) Tension is applied to at least the upper longitudinal edge of the skirt fabric to stretch the upper longitudinal edge. While under such tension, the upper edge of the skirt is attached to the peripheral edge of the top panel. The length of the skirt fabric while so stretched is equal to the peripheral length of the top panel, but the amount of tension that is applied during the attachment is such that the main body of the skirt still can be stretched longitudinally another 5 to 20%. To complete the cover, the ends of the skirt fabric are usually sewn together at seam 19, as indicated in FIG. 1.

A typical knitted fabric skirt of a mattress cover of the invention is at least about 10-inches (25-cm) wide (i.e., in the transverse direction). With such a skirt width and the above-recited stretch and elastic characteristics, a mattress cover of the invention can readily fit a mattress of 7-to-15 inch (18-to-38 cm) width.

Known fitted mattress covers usually require at least four inches (10 cm) of skirt width to be tucked under the mattress. In contrast, fitted mattress covers of the invention require less material to be tucked under. One to three inches (2.5 to 7.5 cm) of skirt width usually is sufficient. Because the total transverse stretch of a skirt of the mattress cover of the invention has a large substantially inelastic stretch component, there is little tendency of the skirt to pull out from under the mattress, once the skirt has been tucked under the mattress. The skirt stays in place.

When a mattress cover of the invention is removed from a mattress to which it had been fitted and then is laundered and dried (or just heated) in a relaxed condition, the skirt substantially regains its original non-stretched width and is again capable of being stretched (inelastically) in the transverse direction, much as it had been originally. Alternatively, the original transverse dimension and stretch of the skirt can be regained by temporarily tensioning the skirt fabric in the longitudinal direction while the skirt is free of tension in the transverse direction.

Although the knit fabrics described above are specifically intended for use in the fitted mattress covers of the invention, such knit fabrics also would be suitable for use in cross-stretchable bandages, ladies halter tops and the like.

TEST METHODS

In the preceding description and in the Examples below, various knitting parameters and certain stretch characteristics of the yarns and the knit skirts of the fitted mattress cover of the invention are given. The methods used to determine these parameters and characteristics are described in this section.

In knitting the skirt fabric, the bulked yarns and the elastic yarns are fed under tension in an extended, taut condition to the knitting needles of the warp-knitting. As the yarns are formed into the stitches, some relaxation of the tension and stretch occurs. The amount of stretch relaxation is determined by comparing the measured length, $L_a$, of tensioned yarn fed to each needle in order to knit a given number of courses with the theoretical length, $L_t$, of yarn needed to follow the linear path of the needle movements used to create the particular stitches. The actual length fed is always greater than the theoretical length required. The percent stretch relaxation, % RS, is then calculated by the formula:

$$\% RS = 100(L_a - L_t)/L_a.$$

The "Pattern Ratio", P, is defined as the ratio of the distance between successive courses, $d_c$, to the distance between successive wales, $d_w$, in the repeating stitch pattern having the longest floats. $P = d_c/d_w$. To illustrate the calculation of P, refer to Example 4 below, wherein the knitting patterns which have the longest floats are formed by 1-0, 2-3 (or 2-3, 1-0). The knitting machine makes 7 courses per 25 mm. Accordingly $d_c = 25/7$ or 3.6 mm. The gage of the machine is 20 (i.e., 20 guides per 25 mm). Because the floats of the particular tricot stitches of this example connect wales that are separated by two needle spaces, there are 10 wales per 25 mm within the pattern. Thus, $d_w = 25/10$ or 2.5 mm, and P=1.43.

When the knitted fabric is removed from the knitting machine, the fabric contracts in both the longitudinal and transverse directions. The contraction ratio, C, in a given direction, is defined as the ratio of the as-knit (i.e., on the machine) length, $Z_k$, of the fabric in that direction, to the length, $z_o$, of the fabric in that direction after it has been removed from the machine, washed and dried; thus, $C=z_k/z_o$.

All the stretch parameters recorded herein for the skirt fabric are measured on samples that were first subjected to a C-wash-and-dry cycle in home-laundry equipment and then allowed to relax for 24 hours at room conditions (i.e., in air at about 25° C. and 50% relative humidity). To obtain samples for measuring the elastic and inelastic stretch characteristics of the skirt, longitudinal strips and transverse strips, each measuring measure 1-inch (2.5-cm) wide by 8-inches (20-cm) long, are cut from the skirt fabric. A standard length of 2.5 cm, parallel to the long edge of the strip, is marked near the middle of the strip. The strip is clamped at opposite ends of a 5-cm length of the strip, with the initially marked 2.5-cm length centrally located between the clamps. The strip is then subjected to tension by suspending a 10-pound (4.54 kg) weight from the lower clamp. This load is usually sufficient to elongate strips from skirt fabrics described in the Examples below and simulates the amount of pull that is exerted on skirt material when as part of a mattress cover it is placed fitted onto a mattress. The extended length, $L_w$, of the original 2.5-cm mark (with the weight in place) is measured and the total stretchability (elastic and inelastic), or %S, in a given direction is then calculated as a percentage of original length by the formula:

$$\%S=100(L_w-2.5)/2.5.$$

Part of the total stretch is inelastic and part is elastic. The percent inelastic stretch, %IS, is measured by removing the weight from the sample and after two minutes re-measuring the length, $L_o$, of the original 2.5-cm mark. The percent inelastic stretch is then calculated by the formula:

$$\%IS=100(L_o-2.5)/2.5.$$

The percent elastic stretch, %ES, is then calculated by the formula:

$$\%ES=100(Lw-Lo)/2.5 \text{ or } \%ES=(\%S-\%IS).$$

EXAMPLES

The following examples further illustrate the invention with the manufacture of fitted mattress covers of the invention. In each example, a skirt fabric is warp knitted; the knitted fabric is removed from the knitting machine and further contracted by being subjected to a C-wash and drying in a relaxed condition; the top edge of the dried fabric is stretched and attached to a top panel to complete a mattress pad cover. Each skirt has elastic yarn knit into or attached to its lower edge. The knitting of each skirt fabric is described. Further fabrication details and the resultant directional total, elastic and inelastic stretch characteristics of each skirt are summarized in a table following Examples 1–6. Example 7 compares the wash durability, "stretch conformability" and puncture resistance of the mattress cover knit skirt fabric of Example 6 versus those of a skirt of stitchbonded fabric.

A 20-gage LIBA warp-knitting machine is used to prepare the knitted skirt fabrics of Examples 1 through 5. A 28-gage Raschel knitting machine is used to prepare the knit fabric skirt of Example 6. Three-bar knitted skirt fabrics are prepared in each example, except Example 1, in which a one-bar knitted skirt fabric is prepared. In the examples, one or more of five different yarns are used in the knitting. The yarns are identified as follows:

Y-1 a combination yarn of 70-denier (78-dtex) LYCRA® spandex air-jet-entangled with 40-den (44-dtex) 34-filament nylon Y-2 a combination yarn of 140-den (156-dtex) LYCRA® spandex air-jet-entangled with 40-den (44-dtex) textured nylon (a bulked elastic yarn).

Y-3 a combination yarn of 140-den (156-dtex) LYCRA® spandex air-jet-entangled with 70-den (78-dtex) textured polyester (a bulked elastic yarn).

Y-4 a bulked yarn of textured 70-den (78-dtex) 34-fil. nylon

Y-5 a bulked yarn of textured 70-den (78-dtex) 34-fil. polyester

The guide bars of the knitting machine are operated to produce repeating stitch patterns, designated as follows:

P-1 1-0, 0-1 chain

P-2 1-0, 1-2 tricot

P-3 1-2, 1-0 tricot

P-4 1-0, 2-3 tricot

P-5 2-3, 1-0 tricot

P-6 1-0, 1-0, 2-1, 2-1, 1-2, 3-2, 2-1, 1-2, 1-2

P-1 through P-5 each repeat every two courses; P-6 repeats every nine courses.

Example 1

A 1-oz/yd$^2$ (34-g/m$^2$) single-bar fabric is knit with 14 courses per inch (14 per 25 mm) with a 20-gage guide bar fully threaded, two yarns per guide, with a combination yarn of 70-denier (78-dtex) LYCRA® spandex air-jet-entangled with 40-den (44-dtex) 34-filament nylon (yarn Y-1) and making 1-0, 1-2 (pattern P-2) tricot stitches. Total, elastic and inelastic stretch characteristics of the skirt, as well as other manufacturing details are given in the table below.

Example 2

A 1.5-oz/yd$^2$ (51-g/m$^2$) three-bar fabric is knit with 14 courses per inch (5.5/cm), each guide bar being 20 gage and fully threaded, one yarn per guide, with the same spandex-containing combination yarn as in Example 1 (yarn Y-1). The back, middle and front bars of the knitting machine, respectively form 1-0, 1-2 (pattern P-2), 1-2, 1-0 (pattern P-3) and 1-0, 1-2 (pattern P-2) tricot stitches. The table below provides further fabrication details and stretch characteristics of the resultant skirt fabrics.

Example 3

A 1.8-oz/yd$^2$ (61-g/m$^2$) three-bar fabric with the same stitch patterns, course and wale spacings as in Example 2, except that a bulked 70-den, 34-filament textured nylon yarn (yarn Y-4) is used in place of the spandex-containing combination yarn. Although the resultant as-knit fabric does not contract as much as the fabric of Example 2, the fabric of this example develops very desirable stretch characteristics after being washed and dried, as shown in the summary table below.

Example 4

A 2.0-oz/yd$^2$ (68-g/m$^2$) three-bar fabric is knit with 7 courses per inch 2.8/cm) with each 20-gage guide bar threaded, as follows. The back and middle bars are each filly threaded with bulked 70-den 34-filament textured polyester yarns (yarn Y-5) and respectively form 1-0, 2-3 (pattern P-4) and 2-3, 1-0 (pattern P-5) tricot stitches. The front bar is threaded with a combination yarn of 140-denier (156-dtex) LYCRA® spandex air-jet-entangled with 40-den (44-dtex) 34-filament textured nylon (yarn Y-2), and forms 1-0, 0-1 chain stitches. The front bar threading sequence is 2 guides full, 8 guides empty, for 14 inches (35.6 cm) across the bar, and two yarns per guide for 8 guides. The chain stitched spandex-containing lanes, which are repeated every 14 inches 35.6 cm) provide the elastic edges of the skirt. Further fabrication details and stretch characteristics of the resultant skirt fabric are given in the table below.

Example 5

A 1.9-oz/yd$^2$ (64-g/m$^2$) three-bar fabric is knit with 14 courses per inch (5.5/cm) with each 20-gage guide bar threaded, as follows. The back and middle bars are each fully threaded with the same bulked polyester yarn (Y-5) as in Example 4 and respectively form 1-0, 1-2 (pattern P-2) and 1-2, 1-0 (pattern P-3) tricot stitches. The front bar is threaded with a combination yarn of 140-denier (156-dtex) LYCRA® spandex air-jet-entangled with textured 70-den (77-dtex) 34-filament polyester (yarn Y-3), and forms 1-0, 0-1 chain stitches. The front bar threading sequence is the same as in Example 4. Additional details are given in the table below.

Example 6

A 2.2-oz/yd$^2$ (74-g/m$^2$) three-bar fabric is knit with 12 courses per inch (4.7/cm) with each 28-gage guide bar threaded, as follows. The back and front bars are each fully threaded with the same bulked polyester yarn (Y-5) as in Example 4 and respectively form 1-0, 2-3 (pattern P-4) and 2-3, 1-0 (pattern P-3) tricot stitches. Every other needle of the middle bar is threaded with a combination yarn of 140-denier (156-dtex) LYCRA® spandex air-jet-entangled with textured 40-den (44-dtex) 34-filament nylon (yarn Y-2), and forms 1-0, 1-0, 2-1, 2-1, 1-2, 3-2, 2-1, 1-2, 1-2 stitches. Further knitting details and stretch characteristics of the resultant fabric are given in the table below.

Each of the skirt fabrics of the examples has desirable elastic stretch characteristics in the longitudinal direction and inelastic stretch characteristics in the transverse direction. Subjecting each of the skirt fabrics to at least five C-wash-and-dry cycles results in negligible pilling occurs with these knit skirt fabrics. Also, the favorable stretch characteristics can be regained after such treatment.

To complete the fabrication of a fitted mattress cover 10 with each of the knit skirts of the examples, a 16.5-foot (4.88-meter) long, 14-inch (0.36-meter) wide skirt fabric 14 is placed under a tension at its upper edge 18. The tension is adjusted to longitudinally stretch the skirt fabric to a length that is about 20% less than the measured total %S in that direction for the skirt fabric. While so stretched, the upper edge of the skirt fabric is attached by sewing to a top panel 12. The ends of the skirt fabric are then sewn together at seam 19 to complete the mattress cover. The mattress cover is intended for a queen-size mattress that measures about 78-inches (1.9-m) long, 60-inches (1.52-m) wide and 9-inches (0.23-m) thick.

Each of the above-described mattress covers is installed on a queen sized mattress. The longitudinal elastic retractive forces within the skirt cause the skirt to fit smoothly, snugly and neatly around the sides and ends of the mattress. The inelastic transverse stretch of the skirt permits the skirt to be remain in place without a tendency to "ride up" on the sides and ends of the mattress, once the transversely stretched skirt is tucked under the mattress.

After removal from the mattress, the covers are subjected to ten C-wash-and-dry cycles in a home laundry and dryer. The covers are then replaced on mattresses. The covers again are installed easily and fit neatly and snugly around the side and ends of the mattress. Note that in Example 1 only one bar is threaded.

TABLE I

Knit Skirt Fabrication and Characteristics

| Example No. | 1 | 2 | 3 | 4 | 5 | 6 |
|---|---|---|---|---|---|---|
| Gage (guides/25 mm) | 20 | 20 | 20 | 20 | 20 | 28 |
| Courses/25 mm | 14 | 14 | 14 | 7 | 14 | 12 |
| Back Bar | | | | | | |
| Yarn | Y-1 | Y-1 | Y-4 | Y-5 | Y-5 | Y-5 |
| Stitch | P-2 | P-2 | P-2 | P-4 | P-2 | P-4 |
| % RS | 15 | 15 | 13 | 20 | 15 | 13 |
| Middle Bar | | | | | | |
| Yarn | — | Y-1 | Y-4 | Y-5 | Y-5 | Y-2 |
| Stitch | — | P-3 | P-3 | P-5 | P-3 | P-6 |
| % RS | — | 15 | 15 | 10 | 10 | 15 |
| Front Bar | | | | | | |
| Yarn | — | Y-1 | Y-4 | Y-2 | Y-3 | Y-5 |
| Stitch | — | P-2 | P-2 | P-1 | P-1 | P-5 |
| % RS | — | 15 | 12 | 10 | 10 | 12 |
| Course Spacing, $d_c$, mm | 1.8 | 1.8 | 1.8 | 3.6 | 1.8 | 2.1 |
| Pattern ratio, P, $d_c/d_w$ | 1.43 | 1.43 | 1.43 | 1.43 | 1.43 | 1.17 |
| As-knit unit weight, g/m$^2$ | 34 | 51 | 61 | 68 | 64 | 74 |
| Contraction Ratio, C | | | | | | |
| Longitudinal, LD | 2.8 | 2.9 | 2.1 | 2.5 | 2.8 | 2.5 |
| Transverse, TD | 1.1 | 2.1 | 1.0 | 1.1 | 1.1 | 1.1 |
| Fabric Stretch, | | | | | | |
| LD Total % S | 200 | 210 | 120 | 163 | 180 | 160 |
| LD Elastic, % ES | 190 | 200 | 100 | 161 | 130 | 110 |
| LD Inelastic, % IS | 10 | 10 | 20 | 2 | 50 | 50 |
| TD Total, % S | 180 | 200 | 210 | 195 | 210 | 215 |
| TD Elastic, % ES | 90 | 80 | 63 | 131 | 52 | 33 |
| TD Inelastic, % IS | 90 | 120 | 147 | 64 | 158 | 182 |

Example 7

This example illustrates the advantages of a mattress cover of the invention having a stretchable knit skirt over a mattress cover having a stretchable stitchbonded skirt. The stretchable knit skirt fabric of Example 6 is compared to a stretchable stitchbonded fabric of very similar construction. The two skirts are subjected to a series of tests which simulate the mechanical deformation, stretching and puncture hazard that a skirt fabric of a fitted mattress cover would be subjected to during multiple wash and dry and use-on-a-mattress cycles.

For purposes of comparison, a stitchbonded stretchable skirt was fabricated in a similar manner and to about the same finished weight as the knit skirt fabric of Example 6. The same repeating stitch patterns and the same yarns were used on the front and middle bars of the stitchbonding machine as were used on knitting machine employed to make the skirt fabric of Example 6. However, the stitchbonding machine (a) had a gage (i.e., guides per 25 cm) of 14 instead of the 28 gage of the knitting machine, (b) inserted 9 courses per 25 cm instead of the 12 courses/cm of the knitting machine and (c) was overfed 10% with a 0.7 oz/yd$^2$ (24 g/m$^2$) Sontara® spunlace fabric (manufactured by E. I. Du Pont de Nemours and Co) instead of employing a front bar as in the knitting machine of Example 6. After washing and drying the finished stitchbonded skirt fabric weighed of the 72 g/m$^2$; the weight of the knit skirt fabric of Example 6 used in this comparison was 73 g/m$^2$.

A wash-durability test of the two skirt samples was performed, as follows. A sample of skirt fabric measuring 12 inches (30.5 cm)in the longitudinal direction and 18 inches (47.7 cm) in the transverse direction was folded on itself to form a three-layer sample having overall dimensions of 12 by 6 inches (30.5 by 15.3 cm). The folded sample was clamped at both its 6-inch-wide ends and stretched fully (i.e., about 275–300%, until no further extension was practical without damaging the sample). Then the fabric sample was released from the stretch and subjected to a C-wash in a home laundry washer and drying. The stretching/washing/drying procedure, which simulates the stretching and washing a fitted mattress cover skirt experiences in use, was repeated five times. The weight of the fabric sample was measured before and after five stretch/wash/dry cycles. The stitchbonded skirt fabric lost 10% in weight and exhibited excessive pilling and the start of holes in the fabric. In contrast, the knit skirt fabric of the invention experienced no loss of weight and no change in appearance.

A stretch-conformability and recovery test was performed on skirt fabric samples by the following procedure. A sample of skirt fabric (after having been exposed to one C- wash, dried and allowed to shrink) measuring about 10 inches (25.4 cm) in diameter was placed over the end of the end of a 4-inch (10.3 cm) diameter hollow vertical cylinder to form a "flat cover" over the cylinder. A 1-inch (2.5-cm) diameter circle was drawn in ink in the center of the flat cover. The edge of the sample overhanging the cylinder was drawn down uniformly (i.e., stretched) over the end of the cylinder as much as it could be without tearing the sample. The stretched diameter of the marked circle was then measured; the sample released from the pulling tension; allowed to recover from the tension; and then the diameter of the marked circle was measured again. In this test, the washed dried and shrunken samples of the knit skirt fabric and the stitchbonded skirt fabric respectively weighed 4.1 oz/yd$^2$ (139 g/m$^2$) and 4.3 oz/yd$^2$ (146 g/m$^2$) The following table summarizes the results of this stretch-conformability and recovery test.

| Skirt fabric sample | Knit of invention | Stitchbonded |
|---|---|---|
| Diameter after stretch, cm | 5.1 | 4.6 |
| % area change after stretch | 525 | 224 |
| Diameter after recovery, cm | 2.4 | 2.8 |
| area recovery after recovery | >100 | 80 |

The above-tabulated data show that a knit fabric skirt made for a mattress cover according to the invention has better stretch and recovery properties than a skirt fabric made by known stitchbonding techniques.

A problem that is sometimes encountered with known stretchable skirt materials is that excessive local stresses is placed on the skirt as the mattress cover is being pulled onto the mattress and failure occurs because a thumb or finger of the person installing the cover punctures the skirt. To simulate this condition, the following puncture test was devised. A sample of skirt fabric, as used in the test of the preceding paragraph, was clamped securely over the end of a 3-inch (7.6-cm) diameter hollow cylinder. A plunger of 1-inch (2.54-cm) diameter having a hemispherical end was placed against the flat surface of the test fabric. The plunger was connected to an Instron Tester which automatically recorded (a) displacement of the plunger as it was forced downward against the fabric sample, (b) the force required to create the displacement and (c) the work required for the plunger to penetrate (i.e., break through) the fabric. The work is the area under the recorded curve of force versus displacement, from zero displacement to the displacement at the point of break, and is reported herein in cm-kg/cm$^2$ of fabric area directly under the plunger The following table summarizes the results of this "skirt puncture" test.

| Skirt fabric sample | Knit of invention | Stitchbonded |
|---|---|---|
| Force at break, Kg | 28.6 | 22.9 |
| Displacement at break, cm | 9.7 | 5.3 |
| Work to puncture, Kg-cm/cm$^2$ | 5.4 | 27 |

The comparison data of this example clearly show the knit skirt fabric of the mattress cover of the invention to have greater wash durability, conformability, and much more puncture resistance than comparable skirts made of stitchbonded fabric.

I claim:

1. A fitted mattress cover comprising:

a flat top panel of substantially inextensible fabric for overlaying the top surface of a mattress; and a skirt of stretchable knitted fabric attached to and depending from a periphery of the top panel, wherein the stretchable knitted fabric consists essentially of bulky yarns and elastic yarns formed into one or more bars of repeating patterns of stitches, the repeating stitch patterns forming courses, wales and floats that connect successive courses and wales, the successive courses extending in a transverse direction perpendicular to the periphery of the top panel and being a distance, $d_c$, of at least 1.25-millimeters apart, the wales extending in a longitudinal direction parallel to the periphery of the top panel, and successive wales in the pattern of stitches having the longest floats being separated by a distance, $d_w$, such that the pattern ratio of $d_c/d_w$ is at least 1.0, and the skirt further having a top edge and a bottom edge, each edge extending in the longitudinal direction and optionally having elastic bands or elastic yarns incorporated therein.

2. A fitted mattress cover in accordance with claim 1 wherein the pattern ratio is at least 1.2.

3. A fitted mattress cover in accordance with claim 2 wherein the pattern ratio is at least 1.4.

4. A fitted mattress cover in accordance with claim 1 wherein the elastic yarn of the knitted fabric of the skirt is a textured stretch yarn of synthetic organic filaments, an elastomeric yarn or an elastic combination yarn.

5. A fitted mattress cover in accordance with claim 4 wherein the elastic yarn is an combination yarn of spandex air-jet entangled with textured filaments of nylon or polyester.

6. A fitted mattress cover in accordance with claim 1, wherein the knitted skirt fabric has an elastic stretch in the longitudinal direction of at least 50% and an inelastic stretch in the transverse direction of at least 60%.

7. A fitted mattress cover in accordance with claim 6 wherein the elastic stretch in the longitudinal direction is in the range of 75 to 150% and the inelastic stretch in the transverse direction is in the range of 100 to 200%.

8. A fitted mattress cover in accordance with claim 7 wherein the inelastic stretch in the transverse direction is substantially completely recoverable when the skirt fabric is laundered and dried in a relaxed condition.

9. A process for preparing a fitted mattress cover having a stretchable skirt comprising the steps of forming a flat top panel of substantially inextensible fabric, the panel having a peripheral edge;

knitting a skirt fabric with bulky yarns and elastic yarns threaded on one or more bars of a warp-knitting machine to form the skirt fabric with upper and lower longitudinal edges, the yarns being tensioned sufficiently during the knitting to maintain the yarns in a substantially taut condition and being knit into repeating patterns of stitches, the patterns forming wales and courses with successive courses being at least 1.25 millimeters apart and successive wales in the stitch pattern having the longest floats being separated by a distance that is no greater than the distance between successive courses;

removing the thusly knit skirt fabric from the knitting machine;

contracting the knit skirt fabric in a direction parallel to the longitudinal edges to a length in the range of one-half to one-third its non-contracted as-knit length:

applying sufficient tension to at least the upper longitudinal edge of the skirt fabric so that the upper longitudinal edge is stretched to within 5 to 20% of the total longitudinal % stretch that the skirt fabric can reach; and attaching the thusly stretched upper longitudinal edge of the skirt fabric while under the tension to the peripheral edge of the top panel.

* * * * *